US005738360A

United States Patent [19]

Petell et al.

[11] Patent Number: 5,738,360

[45] Date of Patent: Apr. 14, 1998

[54] TOE PICK AND SKATE FRAME FOR IN-LINE SKATES

[75] Inventors: John J. Petell, Malden, Mass.; Nicolas A. Perna, Manassas, Va.

[73] Assignee: Harmony Sports, Inc., Malden, Mass.

[21] Appl. No.: 520,653

[22] Filed: Aug. 29, 1995

[51] Int. Cl.[6] ..... A63C 17/14

[52] U.S. Cl. ..... 280/11.22; 280/11.2; 280/11.27

[58] Field of Search ..... 280/11.2, 11.22, 280/11.23, 11.27, 11.19, 87.042

[56] References Cited

U.S. PATENT DOCUMENTS

| | | | |
|---|---|---|---|
| Re. 32,346 | 2/1987 | Klamer et al. | 280/11.2 |
| D. 265,115 | 6/1982 | Dornseif | D21/226 |
| D. 364,437 | 11/1995 | Pratt | D21/226 |
| 899,963 | 9/1908 | Ferguson . | |
| 1,017,162 | 2/1912 | Naumann . | |
| 2,048,916 | 7/1936 | Bentzlin . | |
| 2,566,757 | 9/1951 | Rice . | |
| 2,595,751 | 5/1952 | Balstad . | |
| 2,631,861 | 3/1953 | Daniska . | |
| 2,644,692 | 7/1953 | Kahlert . | |
| 3,968,973 | 7/1976 | McCormack | 280/11.2 |
| 4,181,227 | 1/1980 | Balstad | 280/11.2 |
| 4,199,165 | 4/1980 | Spitzke | 280/87.04 |
| 4,298,209 | 11/1981 | Peters | 280/11.2 |
| 4,379,564 | 4/1983 | Welker | 280/11.2 |
| 4,909,523 | 3/1990 | Olson | 280/11.2 |
| 5,028,058 | 7/1991 | Olson | 280/11.22 |
| 5,052,701 | 10/1991 | Olson | 280/11.2 |
| 5,160,155 | 11/1992 | Barachet | 280/87.042 |
| 5,207,438 | 5/1993 | Landers | 280/11.2 |
| 5,280,931 | 1/1994 | Horton | 280/11.22 |
| 5,295,701 | 3/1994 | Reiber et al. | 280/11.22 |
| 5,308,093 | 5/1994 | Walin | 280/11.2 |
| 5,472,218 | 12/1995 | Pratt | 280/11.2 |

FOREIGN PATENT DOCUMENTS

| | | |
|---|---|---|
| 90-321389/43 | 10/1990 | Germany . |
| 191872 | 7/1937 | Switzerland . |
| 20811 | of 1909 | United Kingdom . |
| 453425 | 9/1936 | United Kingdom . |

*Primary Examiner*—Richard M. Camby
*Attorney, Agent, or Firm*—Richard B. Smith

[57] ABSTRACT

A toe pick for an in-line skate provides figure skaters with a means for performing various skating maneuvers the same as performed on ice skates. The positioning and configuration of the toe pick effectively prevents the skater from over-rotating while providing a pick point used to center the skater's body in preparation for a jump or other type of stunt. The invention features a cylindrical toe pick disk held rotationally mobile by locking means, and secured to the in-line wheel frame of the skate forward of the toe wheel so as not to contact the ground during normal skating action. Although rotationally mobile, the toe pick disk is orientated to have a central axis parallel to the axis of rotation of each of the in-line skate wheels. The toe pick disk is positioned so that it contacts the horizontal skating surface, e.g., the ground, when the axis passing through the axles of the front and rear wheels of the in-line skate form an angle of between 5° and 20°. The invention also features an integral wheel frame constructed from a single piece metal extrusion machined to accommodate boot toe and heel mounting surfaces. The integral wheel frame can be produced in a variety of sizes by maintaining the same boot toe mounting surface and wheel and toe pick disk placement along the frame, but changing the position of the heel mounting surface.

23 Claims, 5 Drawing Sheets

FIG. 10
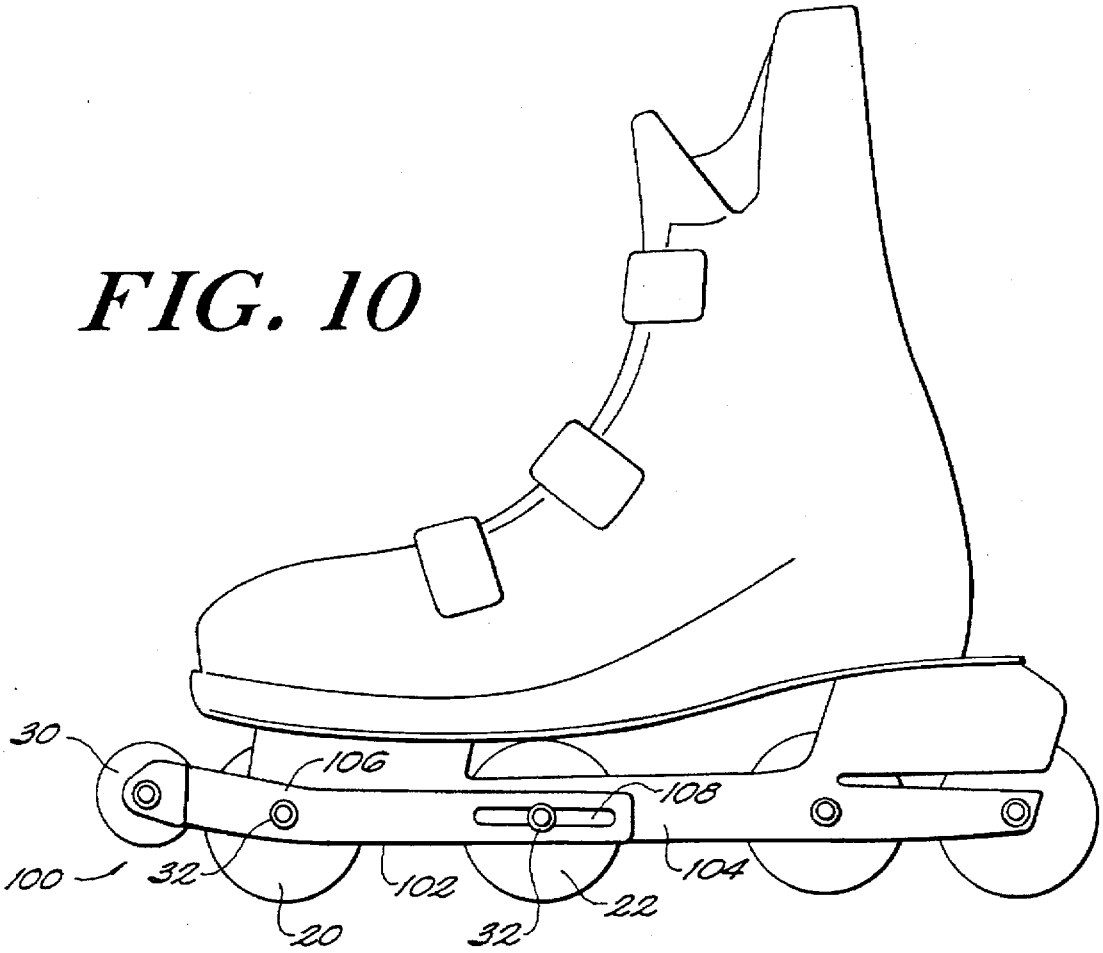
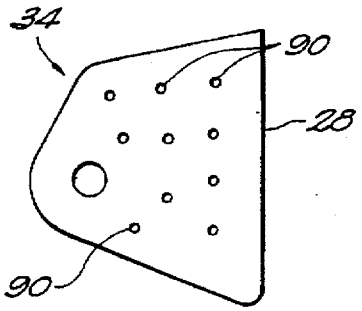
FIG. 8
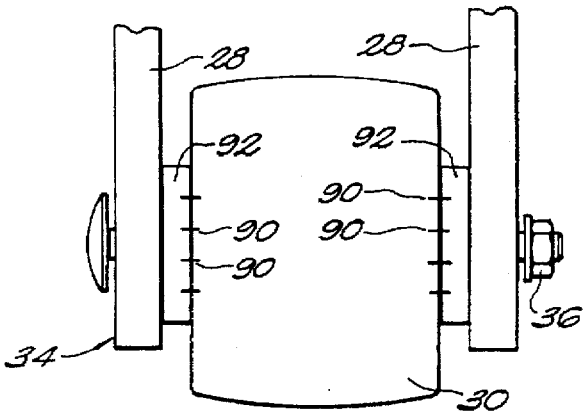
FIG. 9

TOE PICK AND SKATE FRAME FOR IN-LINE SKATES

FIELD OF THE INVENTION

This invention relates to a toe pick for in-line figure skates.

BACKGROUND OF THE INVENTION

At the present time, recreational in-line skates are available for figure, hockey and racing skaters, and feature a boot for fitting the foot of the skater, and rollers attached to the boot. The rollers of in-line skates are aligned in a common plane along a single row from the toe to heel, rather than in two rows such as with conventional roller skates.

In-line skates have been developed for figure skaters to simulate the action of an ice skate blade against the ice. Such in-line figure skates offer the figure ice skater the ability to train off the ice on the ground. In-line figure skates also offer skaters the ability to figure skate even if the skater has never been on ice skates. Although in-line skates are effective at simulating the feel and action of an ice skate blade against the ice, no effective toe pick has heretofore been developed to simulate the toe pick commonly found on ice figure skates, i.e., the serrated edge found on the toe of a figure skate blade. Without an effective toe pick for the in-line figure skate, it is virtually impossible for an in-line figure skater to perform stunts or maneuvers requiring a leap off the front wheel, or a forward lean beyond vertical, without over-rotating and falling forward.

Accordingly, it would be desirable to provide a toe pick for an in-line figure skate which would enable the skater to perform a wide variety of stunts and maneuvers on land such as jumps, figures, three-turns and other moves where a forward lean is required without over-rotating or over-rocking, and thereby effectively simulating the action of an ice skate toe pick.

SUMMARY OF THE INVENTION

In accordance with the present invention, a toe pick for an in-line skate provides figure skaters with a means for performing various skating maneuvers the same as performed on ice skates, including jumps, figures, three-turns and other moves where a forward lean is required. The positioning and configuration of the toe pick of this invention effectively prevents the skater from over-rotating while providing a pick point used to center the skater's body in preparation for a jump or other type of stunt.

In general, in one aspect, the invention features a cylindrical toe pick disk held rotationally mobile by locking means, and secured to the in-line wheel frame of the skate forward of the toe wheel so as not to contact the ground during normal skating action. Although rotationally immobile, the toe pick disk is orientated to have a central axis parallel to the axis of rotation of each of the in-line skate wheels.

In preferred embodiments of the invention, the toe pick disk is held rotationally immobile with respect to the frame by a pin, such as a bolt or set screw, passing through the toe pick disk off-center from the central axis of the disk and secured to the frame. In other embodiments, the toe pick disk is held rotationally immobile by one or more protrusions from the frame positioned adjacent to the disk so as to contact the side of the disk when the frame is tightened against the toe pick disk. The toe pick disk is rotatable to a new immobile position to allow the skater to use a fresh toe pick surface after a portion of the toe pick disk is worn though use.

In yet other preferred embodiments of the invention, the toe pick disk is positioned so that it contacts the horizontal skating surface, e.g., the ground, when the axis passing through the axles of the front and rear wheels of the in-line skate form an angle of between 5° and 20°. In other embodiments the angle is between 10° and 15°. Preferably, the angle is about 12°.

In still other preferred embodiments, the invention features an integral wheel frame constructed from a single piece metal extrusion machined to accommodate boot toe and heel mounting surfaces. The integral wheel frame is produced in a variety of sizes by maintaining the same boot toe mounting surface and wheel and toe pick disk placement along the frame, but changing the position of the heel mounting surface.

Thus, the present invention offers the advantages of an effective toe pick for use by in-line figure skaters to enhance their overall performance by adding much needed training time to their schedules. The toe pick of this invention can be integrated into an extension of the skate frame and positioned to allow lateral moves, e.g., used in hockey, and effective figure skating without interference. The skate frame of this invention can be economically manufactured in a variety of sizes from the same metal extrusion stock. The manufacturing method of this invention allows a variety of frame sizes to be produced having an identical frame structure forward of the toe, which optimizes the operation of the toe pick of this invention.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIG. 8 is an illustration of a series of prong-like protrusions for rotationally immobilizing the toe pick disk of this invention.

FIG. 9 is an illustration of the toe pick disk of this invention utilizing a prong pad between the frame rails and the toe pick disk for rotationally immobilizing the toe pick disk of this invention.

FIG. 10 illustrates an alternative embodiment of the toe pick of this invention featuring opposing rails retro-fitted to an existing in-line skate frame.

DESCRIPTION OF THE EMBODIMENTS OF THE INVENTION

Figure 1:
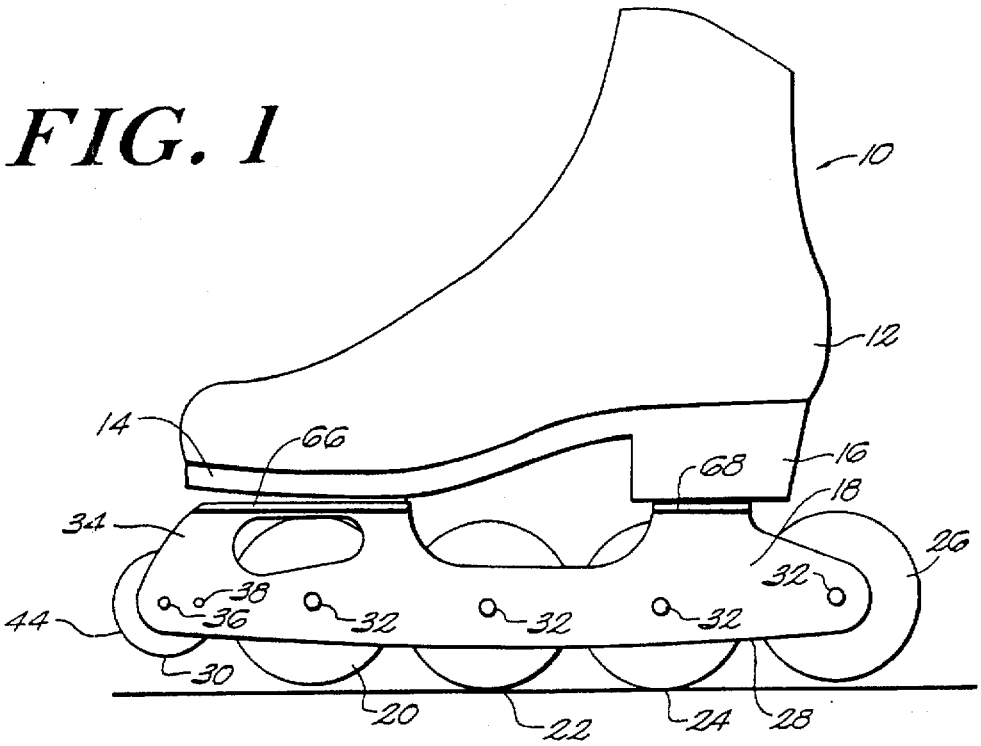
FIG. 1 is a side view of an in-line figure skate toe pick and skate frame of this invention.

Referring to FIG. 1, an in-line skate 10 according to this invention features a boot portion 12, having a toe 14 and a heel 16, attached to a metal wheel frame 18. Wheel frame 18 supports wheels 20, 22, 26 and 26, and a toe pick disk 30 between two opposing side rails 28 formed in the frame 18. Each wheel 20, 22, 24 and 26 is rotatably mounted between the opposing mils 28 by a threaded axle 32 which passes through apertures in the side rails. Wheels 20, 22, 24 and 26 can be almost any type of wheel suitable for use in-line skate use. Preferably, the wheels are 70 mm–72 mm in diameter, are made from high impact urethane materials, and have polymer hubs.

Toe pick disk 30 is mounted on an extended toe portion 34 of side rails 28 by a mounting bolt 36 passing through the center of disk 30, i.e., along the central axis of the disk. A set screw 38 passes through the toe pick disk between the central axis and the peripheral edge of the disk, and locks the toe pick disk 30 so that it cannot rotate about mounting bolt 36. Preferably, the toe pick disk is about 45 mm in diameter, is made from high impact urethane, and has a cylindrical profile. The toe pick disk 30 has a contact edge 44 along its periphery which normally contacts the ground when used as a pick. Ground contact causes the contact edge 44 to wear down and eventually change the characteristics of the pick. Set screw 38 can be removed and the toe pick disk 30 can be rotated to provide a new, fresh contact edge 44. Once a new edge is in position, set screw 38 is replaced through the toe pick disk 30 to prevent rotation, e.g., by providing a series of holes pre-drilled through the disk to select preset contact edge positions, or by drilling a hole though the toe pick disk to accommodate the set screw.

Figure 2:
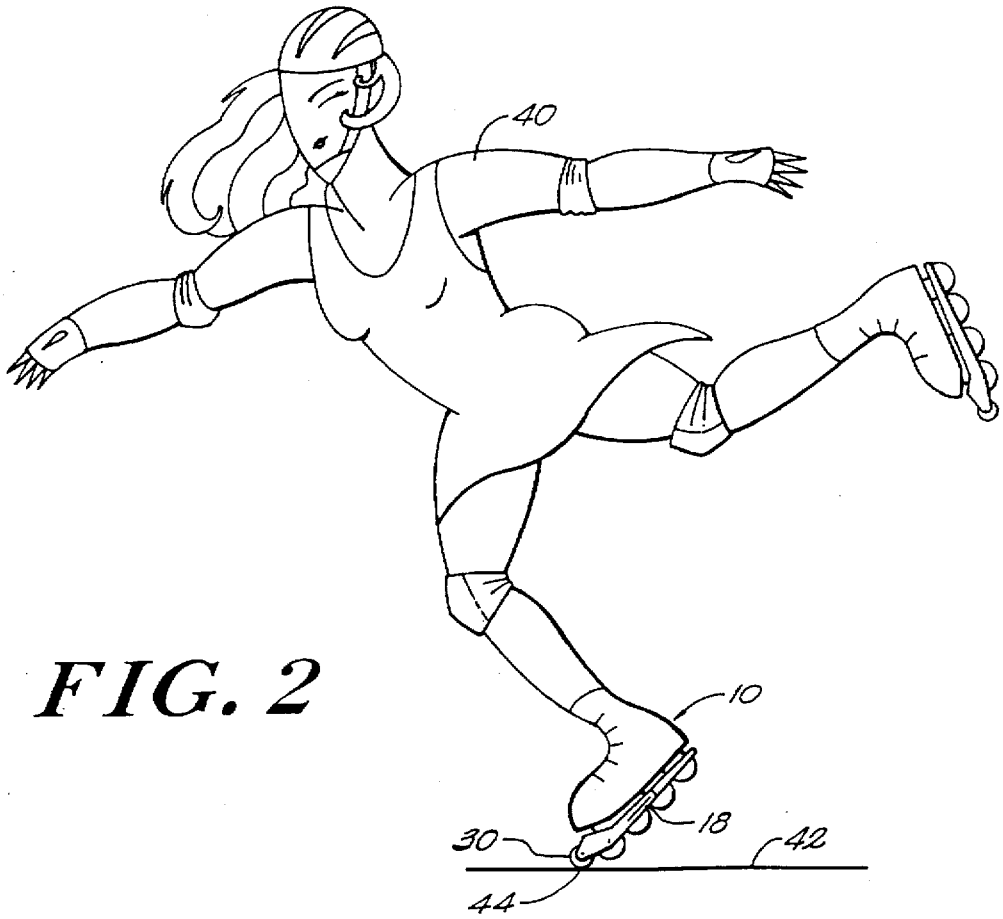
FIG. 2 illustrates the use of the toe pick of this invention.

Referring to FIG. 2, the toe pick disk 30 is used by a skater 40 by leaning forward over the toe of the skate to contact the toe pick disk 30 to the ground 42. The position of the toe pick disk 30 relative to the wheels in accordance with this invention causes the contact edge 44 of the toe pick disk to contact the ground 42 before the skater over-rotates, and positions the skater's body as if the skater is on ice. Furthermore, the cylindrical profile of the toe pick disk 30 gives the skater a continuous pick contact surface as the skater rotates on the pick beyond the point of ground contact to provide a better feel for, and more support from the pick. The toe pick disk 30 of this invention allow the figure skater to perform a wide variety of maneuvers and stunts, including, for example jumps, toe-loops, Lutzes, Salchows, flips, axles, three turns, pivots, brackets and spins.

Figure 3:
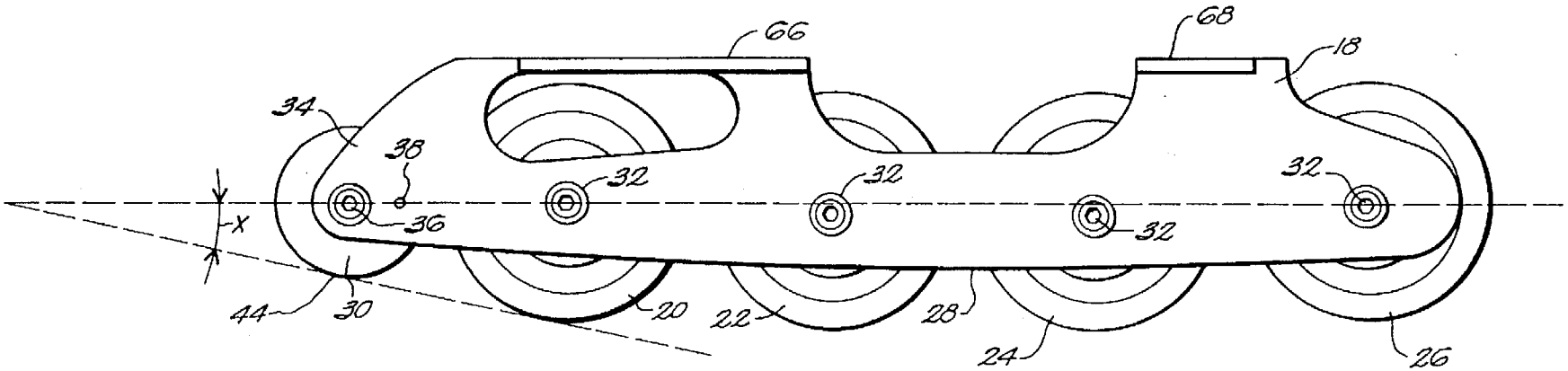
FIG. 3 is a side view of the in-line toe pick and skate frame of this invention detailing the frame construction and relationship of the toe pick to the skate wheels.

Referring to FIG. 3, the from wheel 20 and rear wheel 26 are mounted along a wheel axis 50 passing through the respective axles of the wheels. Center wheels 22 and 24 are typically mounted slightly off axis 50 to provide a rockered configuration for the wheels. Axle 50 is substantially parallel to the skating surface when the center wheels are in contact with the skating surface. Toe pick disk 30 is sized and positioned relative to the wheels such that contact surface 44 first contacts the ground when the skater rotates forward on front wheel 20 at an angle of between about 5° and 20°, and preferably about 12°. This relationship can best be visualized as an angle X formed between wheel axis 50, and a line 52 tangent to both front wheel 20 and toe pick disk 30 representing the ground surface. This configuration allows the bottom of the toe pick disk to contact the ground first as the skater rotates on the disk to a more forward contact position. Dimensionally, in preferred embodiments of the invention using 70 mm to 72 mm diameter wheels, and a 45 mm diameter cylindrical toe pick disk, the center of the toe pick disk 30 is located along axis 50 approximately 2.4 inches forward of the center of the axle of toe wheel 20.

Figure 4:
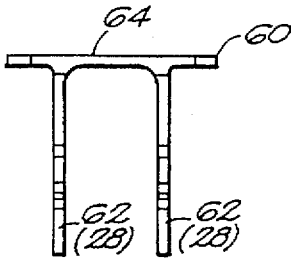
FIG. 4 is a cross-sectional view of an extrusion for manufacturing the skate frame of this invention.
Figure 6B:
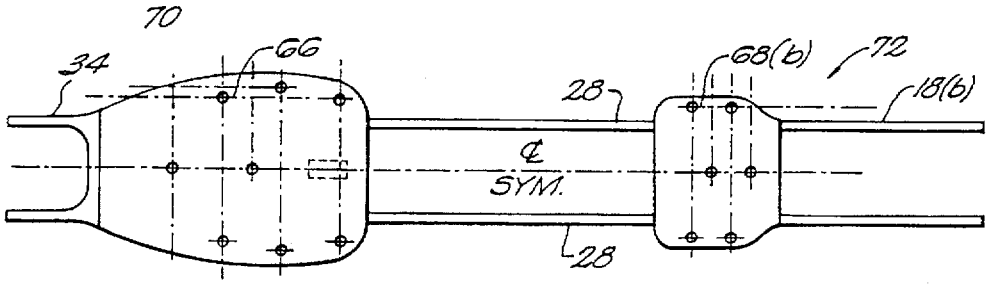
FIGS. 6(*a*) and (*b*) are top views of the skate frame of FIGS. 5(*a*) and (*b*) respectively.
Figure 6A:
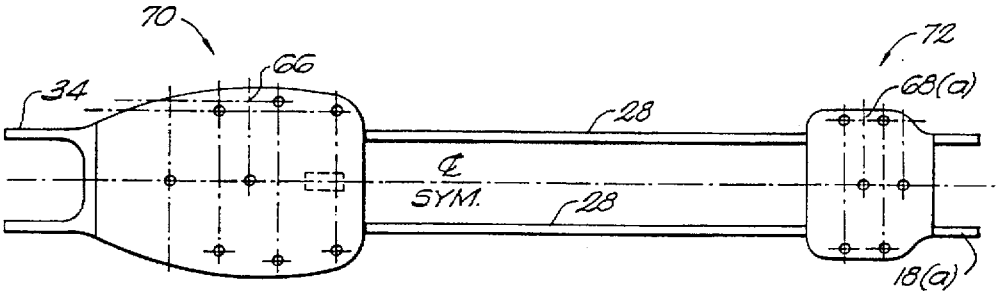

Referring to FIG. 4, the skate frame of this invention can be constructed from a single piece metal extrusion 60 having the profile shown. Extrusion 60 has two opposing vertical surfaces 62 for forming the opposing rails 28 of FIG. 1. The vertical surfaces 62 are substantially perpendicular, and are attached to a flat plate surface 64 of the extrusion 60. Flat plate surface 64 is used to provide mounting plates 66 and 68 for mounting the skate frame to the toe 14 and heel 16 of boot 12 (FIG. 1), respectively. Preferably, extrusion 60 is made from extruded aluminum for light weight, strength, and long life.

Figure 5B:
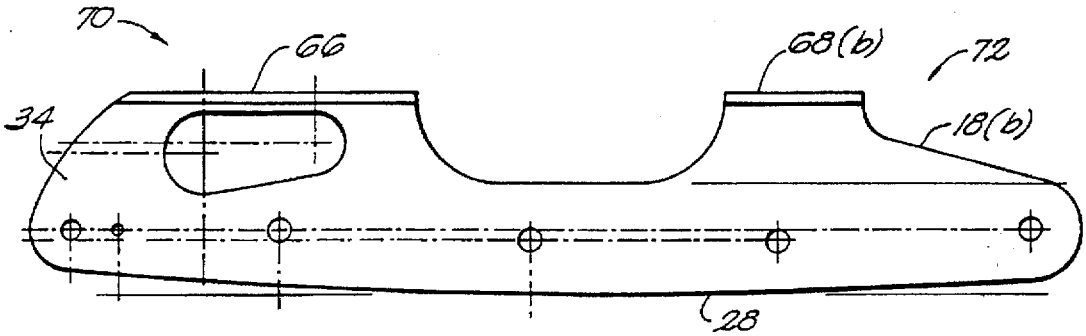
FIGS. 5(*a*) and (*b*) are side views of the skate frame of this invention, with the wheels and toe pick removed for clarity, illustrating the constant geometry toe structure and relocatable heel structure for sizing the frame.
Figure 5A:
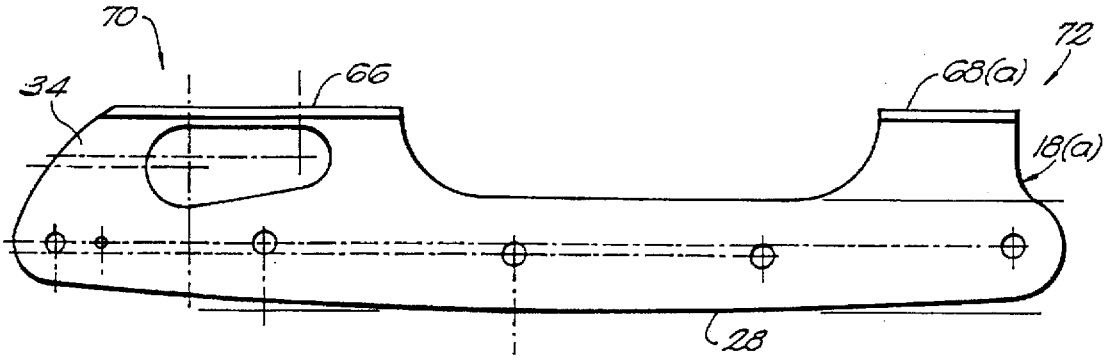

Referring to FIGS. 5(*a*) and (*b*), and 6(*a*) and (*b*), the skate frame 18 of this invention can be machined from the extrusion 60 of FIG. 4 to provide frames fitting a wide range of boot sizes. The favorable toe pick characteristics of this invention are preserved across the entire line of skate sizes by making the toe portion 70 of the frame, including toe mounting plate 66 and toe pick portion 34, geometrically constant over the entire range of sizes. This sets the same toe pick disk position relative to the ball of the foot regardless of the size of the boot and frame. The frame is sized to an appropriate boot by changing the position at which the heel portion 72 of the frame, including the heel mounting plate 68, is machined from the extrusion material. For example, the heel mounting plate 68(*a*) is positioned further away from the toe mounting plate 66 in FIGS. 5(*a*) and 6(*a*) (large boot size), than the heel mounting plate 68(*b*) is positioned from the toe mounting plate 66 in FIGS. 5(*b*) and 6(*b*) (small boot size). In either case, however, the toe portions 70 are identical, as are the length of the opposing rails 28. Preferably, the frames can be made to fit boot sizes 8.75 through 10.75 by appropriately moving the location of the heel mounting plate 68. Furthermore, although the exemplary embodiments are shown in the figures as having four in-line wheels, the frames incorporating this invention are not limited to four wheels, and can have, for example three wheels, or five or more wheels.

Figure 7:
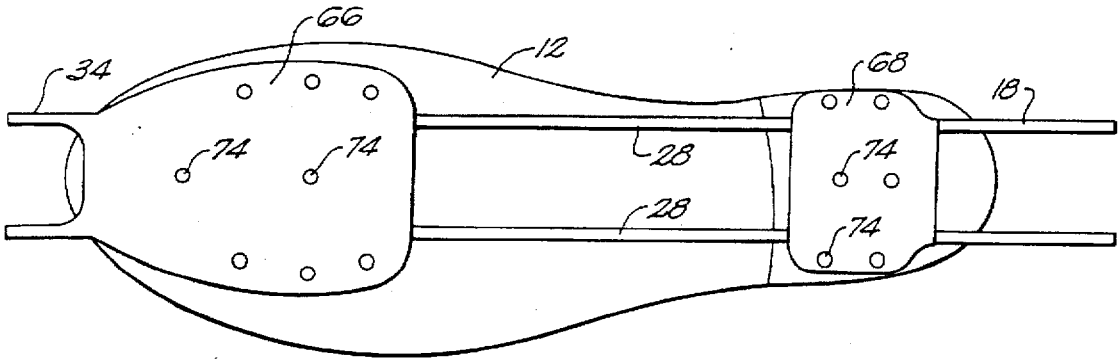
FIG. 7 is a bottom view of the skate frame of this invention, with the wheels and toe pick removed for clarity, illustrating the mounting of the skate frame of this invention to a figure skate boot.

Referring to FIG. 7, there is shown the skate frame 18 of this invention mounted to the bottom of a figure skating boot 12 by means of mounting holes and fasteners 74 in the toe mounting plate 66 and heel mounting plate 68.

Referring to FIG. 8, there is shown an alternative embodiment for rotationally immobilizing the toe pick disk 30 relative to the frame rails 28 by providing a series of prongs 90 protruding from the surface of the frame 28 adjacent to the toe pick disk to embed in the disk and prevent rotation. Alternatively, referring to FIG. 9, protruding prongs 90 can be provided on pads 92 which are captured between the frame rails 28 and the toe pick disk to prevent rotation.

Referring to FIG. 10, there is shown an alternative embodiment 100 of the toe pick of this invention for retro-fitting to an existing in-line skate frame. Toe pick 100 includes opposing rails 102 which lies substantially flat against both sides of the existing in-line skate frame 104. Rails 102 are attached to the frame 104 by means of an attachment hole 106 for attaching to the axle 32 of toe wheel 20, and a slotted hole 108 for attaching to the axle 32 of wheel 22. Toe pick 30 is mounted between the opposing rails 102 and made rotationally immobile relative to the rails as described above with respect to opposing rails 28 of FIG. 1.

Equivalents

While this invention has been particularly shown and described with references to preferred embodiments thereof, it will be understood by those skilled in the art that various changes in form and details may be made therein without departing from the spirit and scope of the invention as defined by the appended claims. For example, although the exemplary embodiments described herein show in-line skates having four wheels, the invention is applicable regardless of the number of wheels included on the skate.

We claim:

1. A toe pick and frame for an in-line skate, comprising a frame for carrying a plurality of wheels substantially in line and in a common plane between two opposing rails, including a toe wheel and a heel wheel, and a toe frame portion of the opposing rails extending forward of the toe wheel, and a substantially cylindrical disk, having a contact surface for contacting the skating surface, the cylindrical disk being mounted between the opposing rats of the toe frame portion and secured to the opposing rails to prevent rotation of the disk and contact surface with respect to the opposing rails, and wherein the cylindrical disk is sized and positioned so that the contact surface does not contact the skating surface during normal skating action and so that the contact surface first contacts the horizontal skating surface upon a skater rotating forward on the toe wheel when an axis passing through the axles of the front and rear wheels form an angle of between 5° and 15° with the horizontal skating surface, and wherein the frame comprises a metal extrusion having elongated opposing side surfaces and an elongated plate surface substantially perpendicular to the opposing side surfaces, and wherein the opposing rails are machined from the opposing side surfaces, and a toe mounting plate is machined from the plate surface at a constant location along the plate surface to maintain the cylindrical disk at substantially the same distance from the toe of the boot, for mounting the frame to the toe portion of a boot, and a heel mounting plate is machined from the plate surface at a location along the plate surface relative to the toe mounting plate accommodate mounting the frame to a given size boot.

2. The toe pick and frame of claim 1, wherein the angle is between about 10° and 15°.

3. The toe pick and frame of claim 2, wherein the angle is about 12°.

4. A toe pick for an in-line skate, comprising a frame for carrying a plurality of wheels substantially in line and in a common plane between two opposing rails, including a toe wheel and a heel wheel, and a toe frame portion of the opposing rails extending forward of the toe wheel, and a substantially cylindrical disk, having a cylindrical contact surface for contacting the skating surface, the cylindrical disk being mounted between the opposing rails of the toe frame portion on an axle passing through the axis of rotation of the cylindrical disk substantially parallel to the axes of rotation of the wheels and the axis of rotation of the cylindrical disk positioned below an axis passing through the axles of the toe and heel wheels, and secured to the opposing rails by a locking protrusion engaging at least one of the opposing rails and the cylindrical disk positioned off-center from the central axis of the cylindrical disk to prevent rotation of the disk and contact surface with respect to the opposing rails, and wherein the cylindrical disk is sized and positioned so that the contact surface does not contact the skating surface during normal skating action and so that the contact surface first contacts the horizontal skating surface upon a skater rotating forward on the toe wheel when the axis passing through the axles of the front and rear wheels form an angle of between 5° and 15° with the horizontal skating surface.

5. The toe pick of claim 4, wherein the protrusion comprises a set screw for engaging threaded holes in the opposing rails.

6. The toe pick of claim 5, wherein the protrusion comprises a through bolt passing though the cylindrical disk and the opposing rails.

7. The toe pick of claim 1, wherein the cylindrical disk is prevented from rotating relative to the opposing rails by a plurality of locking protrusions extending from the opposing rails adjacent to the cylindrical disk for engaging the surface of the cylindrical disk upon tightening the opposing rails against the cylindrical disk.

8. The toe pick of claim 4, wherein the cylindrical disk and contact surface can be rotated and affixed in another rotationally immobile position to provide a new contact surface.

9. The toe pick of claim 1, wherein the angle is between about 10° and 15°.

10. The toe pick of claim 9, wherein the angle is about 12°.

11. The toe pick of claim 1, wherein the frame comprises a metal extrusion having elongated opposing side surfaces and an elongated plate surface substantially perpendicular to the opposing side surfaces, wherein the opposing rails are machined from the opposing side surfaces, and a toe mounting plate, for mounting the frame to the toe portion of a boot, and a heel mounting plate, for mounting the frame to the heel portion of the boot, are machined from the plate surface.

12. The toe pick of claim 11, wherein the toe mounting plate is machined at a constant location along the plate surface, and the heel mounting plate is machined at a different location along the plate surface relative to the toe mounting plate to accommodate mounting the frame to different size boots.

13. A toe pick for an in-line skate, comprising a frame for carrying a plurality of wheels substantially in line and in a common plane between two opposing rails, including a toe wheel and a heel wheel, and a toe frame portion of the opposing rails extending forward of the toe wheel, and a pick member, having a cylindrical contact surface for contacting the skating surface, the pick member being mounted between the opposing rails of the toe frame portion on an axis of rotation positioned below an axis passing through the axles of the toe and heel wheels and secured to the opposing rails to prevent rotation of the pick member and contact surface with respect to the opposing rails, and wherein the pick member is sized and positioned so that the contact surface does not contact the skating surface during normal skating action and so that the contact surface first contacts the horizontal skating surface upon a skater rotating forward on the toe wheel when the axis passing through the axles of the front and rear wheels form an angle of between 5° and 15° with the horizontal skating surface.

14. The toe pick of claim 13, wherein the pick member is mounted to the opposing rails by an axle passing through the pick member substantially parallel to the axes of rotation of the wheels.

15. The toe pick of claim 14, wherein the pick member is prevented from rotating relative to the opposing rails by a locking protrusion engaging at least one of the opposing rails and the pick member positioned off-center from the axle of the pick member.

16. The toe pick of claim 15, wherein the protrusion comprises a set screw for engaging threaded holes in the opposing rails.

17. The toe pick of claim 16, wherein the protrusion comprises a through bolt passing though the pick member and the opposing rails.

18. The toe pick of claim 14, wherein the pick member is prevented from rotating relative to the opposing rails by a plurality of locking protrusios extending from the opposing rails adjacent to the pick member for engaging the surface of the pick member upon tightening the opposing rails against the pick member.

19. The toe pick of claim 14, wherein the pick member can be repositioned to another rotationally immobile position to provide a new contact surface.

20. The toe pick of claim 13, wherein the angle is between about 10° and 15°.

21. The toe pick of claim 20, wherein the angle is about 12°.

22. The toe pick of claim 13, wherein the frame comprises a metal extrusion having elongated opposing side surfaces and an elongated plate surface substantially perpendicular to the opposing side surfaces, wherein the opposing rails are machined from the opposing side surfaces, and a toe mounting plate, for mounting the frame to the toe portion of a boot, and a heel mounting plate, for mounting the frame to the heel portion of the boot, are machined from the plate surface.

23. The toe pick of claim 22, wherein the toe mounting plate is machined at a constant location along the plate surface to maintain the cylindrical disk at substantially the same distance from the toe of the boot, and the heel mounting plate is machined from the plate surface at a location along the plate surface relative to the toe mounting plate to accommodate mounting the frame to a given size boot.

* * * * *